US011800931B1

(12) United States Patent
Wu et al.

(10) Patent No.: US 11,800,931 B1
(45) Date of Patent: Oct. 31, 2023

(54) FOLDING CHAIR FRAMEWORK

(71) Applicant: Haiyong Wu, Ningbo (CN)

(72) Inventors: Haiyong Wu, Ningbo (CN); Zhenhua Wu, Ningbo (CN)

(73) Assignee: Haiyong Wu, Ningbo (CN)

( * ) Notice: Subject to any disclaimer, the term of this patent is extended or adjusted under 35 U.S.C. 154(b) by 0 days.

(21) Appl. No.: 18/346,241

(22) Filed: Jul. 2, 2023

(30) Foreign Application Priority Data

Jun. 6, 2023 (CN) ..... 202310660572.1

(51) Int. Cl.
*A47C 4/00* (2006.01)
*A47C 7/35* (2006.01)

(52) U.S. Cl.
CPC . *A47C 4/00* (2013.01); *A47C 7/35* (2013.01)

(58) Field of Classification Search
CPC .... A47C 5/10; A47C 4/00; A47C 4/28; A47C 7/35; A47C 7/34; A47C 4/44; A47C 4/10; A47C 4/20
See application file for complete search history.

(56) References Cited

U.S. PATENT DOCUMENTS 582,136 A * 5/1897 Comfort ..... A47C 4/286 297/51
5,505,524 A * 4/1996 Drumwright ..... A47C 7/004 297/183.5
10,194,751 B1 * 2/2019 Frankel ..... A47C 9/105
11,439,238 B1 * 9/2022 Wang ..... A47C 4/286
2005/0242646 A1 11/2005 You et al.
2016/0331140 A1 11/2016 Banks
2017/0007026 A1 * 1/2017 Avery ..... A47C 7/006
2017/0181548 A1 * 6/2017 Yoo ..... A47C 4/30

FOREIGN PATENT DOCUMENTS

CN 107455970 A * 12/2017 ..... A47B 11/00

* cited by examiner

*Primary Examiner* — Milton Nelson, Jr.
(74) *Attorney, Agent, or Firm* — Zhigang Ma

(57) ABSTRACT

The present disclosure relates to a folding chair framework, including a connecting seat, a guide rod, a guide sleeve, several chair legs, several supporting rods, several connecting rods, a first spring, a second spring, and wedge-shaped blocks; upper ends of the chair legs are all hinged with the connecting seat; the guide rod is vertically arranged and connected to the connecting seat; the guide sleeve is slidably connected to the guide rod; each connecting rod is hinged with the guide sleeve and one chair leg respectively; upper and lower ends of the first spring are respectively connected to the connecting seat and the guide sleeve; the wedge-shaped blocks are slidably connected into first grooves of the guide rod; two ends of the second spring are respectively connected to the first grooves and the wedge-shaped blocks; the guide sleeve includes an inner sleeve and an outer sleeve.

8 Claims, 7 Drawing Sheets

FOLDING CHAIR FRAMEWORK

TECHNICAL FIELD

The present disclosure relates to the technical field of folding chairs, and particularly, to a folding chair framework.

BACKGROUND

More and more people like outdoor activities, such as camping, picnicking, and fishing. Demands for outdoor products also grow with each passing day. Folding chairs are one of the necessary outdoor appliances. A folding chair can be used as a chair when it is unfolded. The folding chair is favored because it has a small volume after being folded. A folding chair framework includes a connecting seat, a guide rod, a guide sleeve, several chair legs, several supporting rods, and several connecting rods. Upper ends of the chair legs are hinged with the connecting seat; the guide rod is vertically arranged and connected to a bottom end of the connecting seat; the guide sleeve is slidably connected to the guide rod; each connecting rod is hinged with the guide sleeve and one chair leg respectively; and by sliding the guide sleeve, the chair legs are rotated to be unfolded or folded. However, this folding chair framework is unfolded and folded by manually sliding the guide sleeve, which is inconvenient to use, and lacks a stable limiting mechanism during unfolding, posing a certain potential safety hazard.

SUMMARY

For the shortcomings in the prior art, the present disclosure aims to provide a folding chair framework which is convenient to fold and unfold and is more stable in unfolding, so as to solve the technical problems that the folding chair framework in the prior art is inconvenient to use and is unstable during unfolding.

In order to solve the above technical problem, the present disclosure provides a folding chair framework, including a connecting seat, a guide rod, a guide sleeve, several chair legs, several supporting rods, and several connecting rods, wherein upper ends of the chair legs are all hinged with the connecting seat; the guide rod is vertically arranged and connected to a bottom end of the connecting seat; the guide sleeve is slidably connected to the guide rod; each connecting rod is hinged with the guide sleeve and one chair leg respectively; the chair legs are rotated by sliding the guide sleeve; the chair legs support the folding chair framework when unfolded; the folding chair framework further includes a first spring, second springs, and wedge-shaped blocks. Upper and lower ends of the first spring are respectively connected to the connecting seat and the guide sleeve; the guide rod is provided with first grooves; the wedge-shaped blocks are slidably connected into the first grooves; the second springs are transversely arranged, and two ends of the second springs are respectively connected to side walls of the first grooves and the wedge-shaped blocks; and wedge-shaped surfaces are arranged at upper ends of the wedge-shaped blocks. The guide sleeve includes an inner sleeve and an outer sleeve; the inner sleeve is rotatably and slidably connected to the guide rod; the inner sleeve is rotatably connected into the outer sleeve; the outer sleeve is circumferentially provided with a first avoiding slot; the inner sleeve is connected with a pedal; the pedal passes through the first avoiding slot and is exposed out of the guide sleeve; and the inner sleeve is rotated by actuating the pedal to slide along the first avoiding slot. A clamping ball is arranged on an inner wall of the inner sleeve; a sliding chute is formed in an outer wall of the guide rod; the clamping ball is slidably connected into the sliding chute; the inner sleeve is axially provided with second avoiding slots in a penetrating manner; when the guide sleeve slides down from tops of the wedge-shaped blocks to a bottom end of the inner sleeve and resists against the wedge-shaped surfaces, the wedge-shaped surfaces make the wedge-shaped blocks move into the first grooves and make the second springs compressed; and the guide rod is provided with first limiting bulges located below the wedge-shaped blocks. When the chair legs are unfolded, upper and lower ends of the guide sleeve respectively resist against bottom ends of the wedge-shaped blocks and top ends of the first limiting bulges, and the first spring is stretched. At this time, the pedal is located at one end of the first avoiding slot. When the pedal is rotated to the other end of the first avoiding slot, the second avoiding slots are aligned with the wedge-shaped blocks and can allow the wedge-shaped blocks to pass. At this time, the first spring actuates the guide sleeve to move upwards. Furthermore, in the upwards moving process of the guide sleeve, the clamping ball slides along the sliding chute and makes the pedal move to one end of the first avoiding slot.

By the adoption of the above structure, the folding chair framework of the present disclosure has the following advantages: When it is necessary to unfold the folding chair framework, the pedal is treaded to make the guide sleeve slide down. At this time, the wedge-shaped blocks may retract into the first grooves under the action of the wedge-shaped surfaces. After the guide sleeve resists against the first limiting bulges, the wedge-shaped blocks extend out to resist against the guide sleeve, so that the top and bottom of the guide sleeve of the unfolded folding chair framework are respectively limited by the wedge-shaped blocks and the first limiting bulges, and the guide sleeve cannot move, which ensures the stability of unfolding of the folding chair framework. When it is necessary to fold the folding chair framework, the pedal is rotated to align the second avoiding slots with the wedge-shaped blocks. The guide sleeve is driven to move upwards under the action of the elasticity of the first spring, so that the chair legs are folded. Furthermore, in this process, the pedal and the inner sleeve are reset under the actions of the clamping ball and the sliding chute. In next unfolding, the pedal is still treaded to unfold the folding chair framework. Meanwhile, during unfolding, the wedge-shaped blocks and the first limiting bulges limit the guide sleeve, so that it is more convenient for unfolding and folding, and the unfolded folding chair framework is more stable.

As an improvement, the lower end of the first spring is connected to an upper end surface of the outer sleeve. By the adoption of this structure, deflection of the first spring caused by the rotation of the inner sleeve is avoided.

As an improvement, the guide rod is connected with second limiting bulges located above the wedge-shaped blocks; the first spring actuates the guide sleeve to move upwards until an upper end surface of the guide sleeve resists against bottom ends of the second limiting bulges. By the adoption of this structure, the second limiting bulges limit an extreme position of the upward movement of the guide sleeve.

As an improvement, a bottom end of each chair leg is spherical and is sleeved with a rubber pad; and the rubber pad is terrace-shaped. By the adoption of this structure, the chair legs are more stable when supported on the ground, have an antiskid effect, and are more suitable for a complicated pavement. Furthermore, due to the spherical chair legs, the rubber pads can rotate according to the flatness of the pavement and be always landed on a flat ground.

As an improvement, each chair leg includes an outer leg, an inner leg, a sleeve pipe, and a lock piece; the inner leg is slidably connected into the outer leg; the sleeve pipe sleeves the outer leg; one end of each connecting rod is hinged with the sleeve pipe; the lock piece is rotatably connected to the sleeve pipe; the sleeve pipe is provided with a third avoiding slot for allowing the lock piece to pass; the inner leg is provided with a first clamping slot and a second clamping slot, and the first clamping slot is located above the second clamping slot; and the lock piece is rotated to be clamped into the first clamping slot or the second clamping slot. By the adoption of this structure, the inner legs and the outer legs are slidably connected, so that lengths of the chair legs are adjustable. Furthermore, the lock pieces cooperate with the first clamping slots and the second clamping slots to fix the inner legs and the outer legs.

As an improvement, the chair leg further includes a connecting pipe and an elastic clasp; the connecting pipe is hinged with the connecting seat; a through hole is formed in an outer wall of the connecting pipe; an upper end of the elastic clasp is connected to the outer leg; and a lower end is plugged into the through hole and resists against a lower wall of the through hole. By the adoptio of this structure, the elastic clasps are pressed to remove the outer legs from the connecting pipes, to facilitate mounting and removal.

As an improvement, the guide sleeve further includes two annular limiting sheets; and the two limiting sheets are respectively connected to upper and lower ends of the outer sleeve and respectively resist against upper end lower ends of the inner sleeve. By the adoption of this structure, the upper and lower limiting sheets prevent axial movement between the inner sleeve and the outer sleeve.

As an improvement, the sliding chute includes a first vertical section, a second vertical section, a horizontal section, and an inclined section; one end of the horizontal section is connected to a lower end of the first vertical section; the other end of the horizontal section is connected to a lower end of the second vertical section; a lower end of the inclined section is connected to an upper end of the second vertical section; an upper end of the inclined section is connected to an upper end of the first vertical section; when the guide sleeve slides down, the clamping ball slides along the first vertical section; when the pedal moves from one end of the first avoiding slot to the other end of the first avoiding slot, the clamping ball moves from one end of the horizontal section to the other end of the horizontal section; and when the clamping ball moves from the lower end of the inclined section to the upper end of the inclined section, the pedal moves from the other end of the first avoiding slot to one end of the first avoiding slot. By the adoption of this structure, the different sections of the sliding chute respectively play guide roles in different directions on the clamping ball and the inner sleeve, so that the inner sleeve and the pedal can be automatically reset and are more convenient to use.

Figure 1:
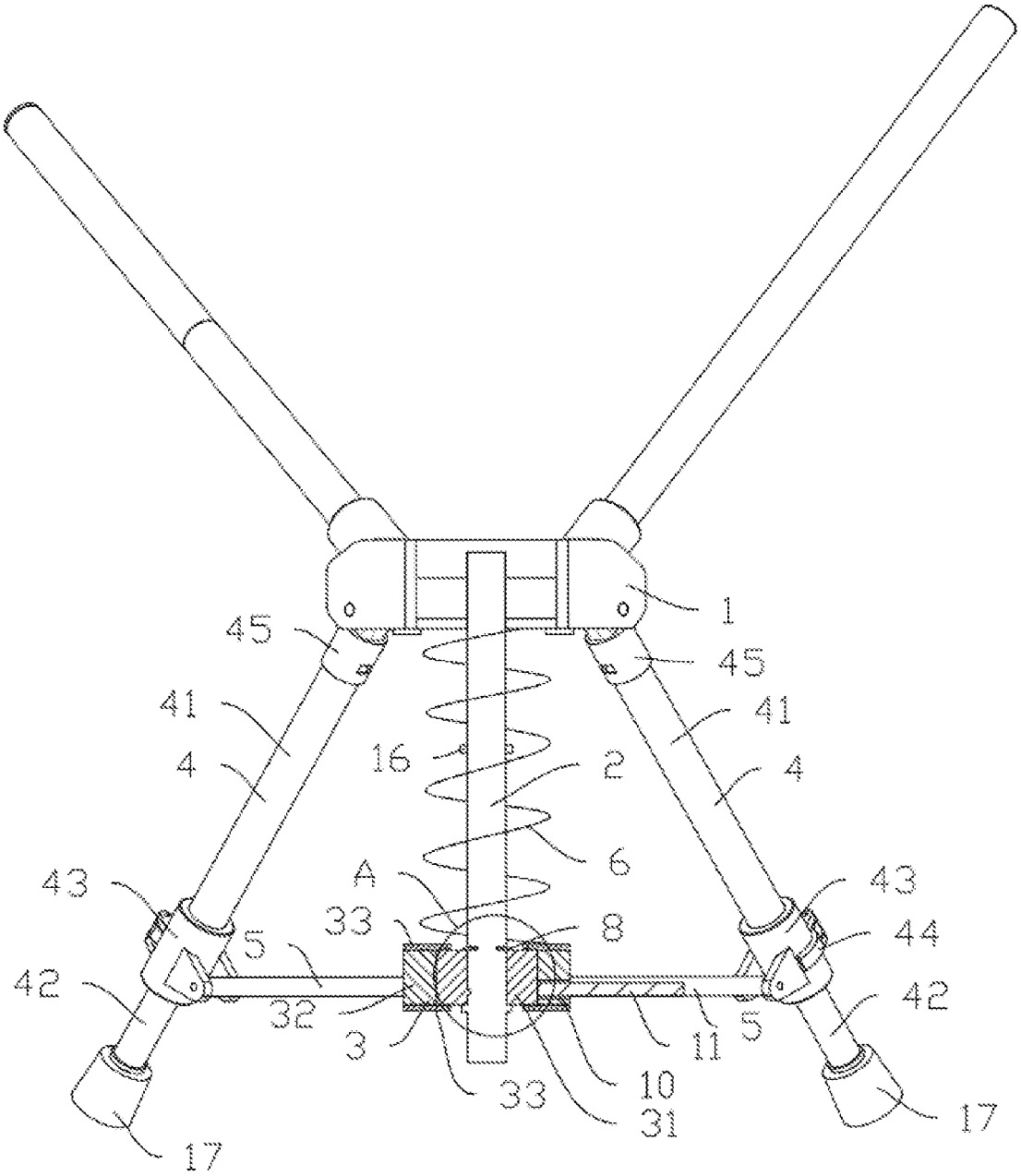
FIG. 1 is a schematic diagram of an entire structure in the present disclosure.

Numerals in the drawings: 1: connecting seat; 2: guide rod; 3: guide sleeve; 31: inner sleeve; 32: outer sleeve; 33: limiting sheet; 4: chair leg; 41: outer leg; 42: inner leg; 43: sleeve pipe; 44: lock piece; 45: connecting pipe; 46: elastic clasp; 5: connecting rod; 6: first spring; 7: second spring; 8: wedge-shaped block; 81: wedge-shaped surface; 9: first groove; 10: first avoiding slot; 11: pedal; 12: clamping ball; 13: sliding chute; 131: first vertical section; 132: second vertical section; 133: horizontal section; 134: inclined section; 14: second avoiding slot; 15: first limiting bulge; 16: second limiting bulge; 17: rubber pad; 18: third avoiding slot; 19: first clamping slot; 20: second clamping slot; and 21: through hole.

DETAILED DESCRIPTION OF THE EMBODIMENTS

A folding chair framework of the present disclosure is described in detail below in combination with the accompanying drawings.

As shown in FIG. 1 to FIG. 7, a folding chair framework includes a connecting seat 1, a guide rod 2, a guide sleeve 3, several chair legs 4, and several connecting rods 5. Upper ends of the chair legs 4 are hinged with the connecting seat 1. In this embodiment, the connecting seat 1 is crossed. There are four chair legs 4 in total, which are respectively hinged with bottom ends of four end portions of the crossed connecting seat 1. Each of top ends of the four end portions of the crossed connecting seat 1 is connected with one supporting rod to mount a seat.

Figure 5:
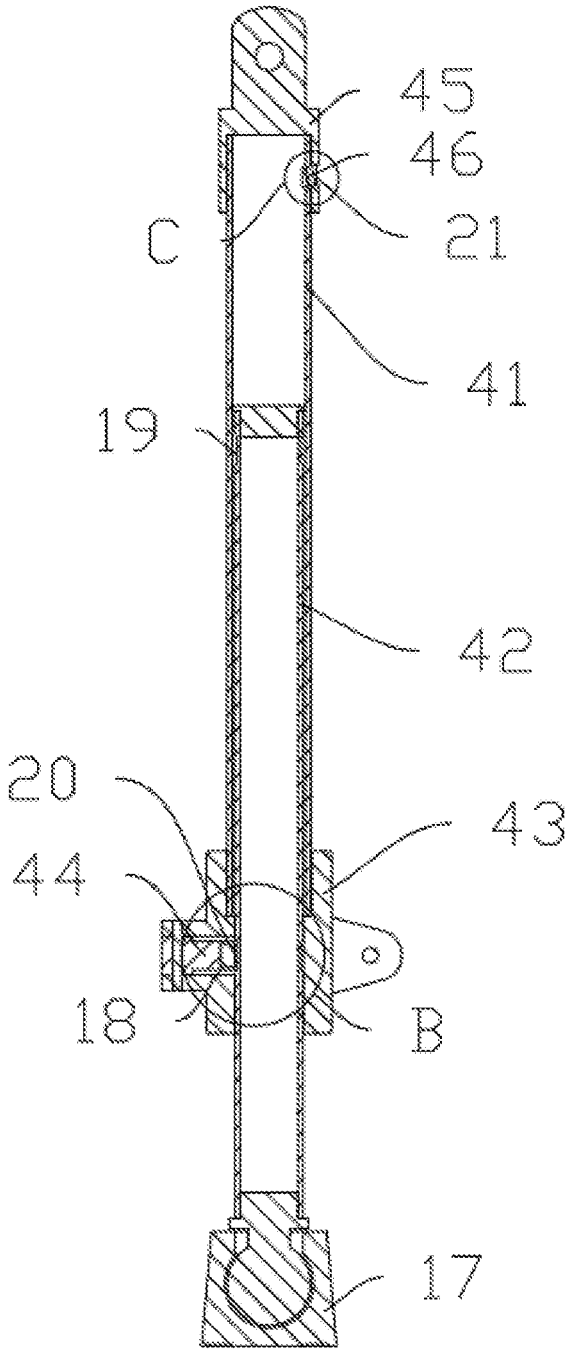
FIG. 5 is a schematic structural diagram of a chair leg in the present disclosure.
Figure 6:
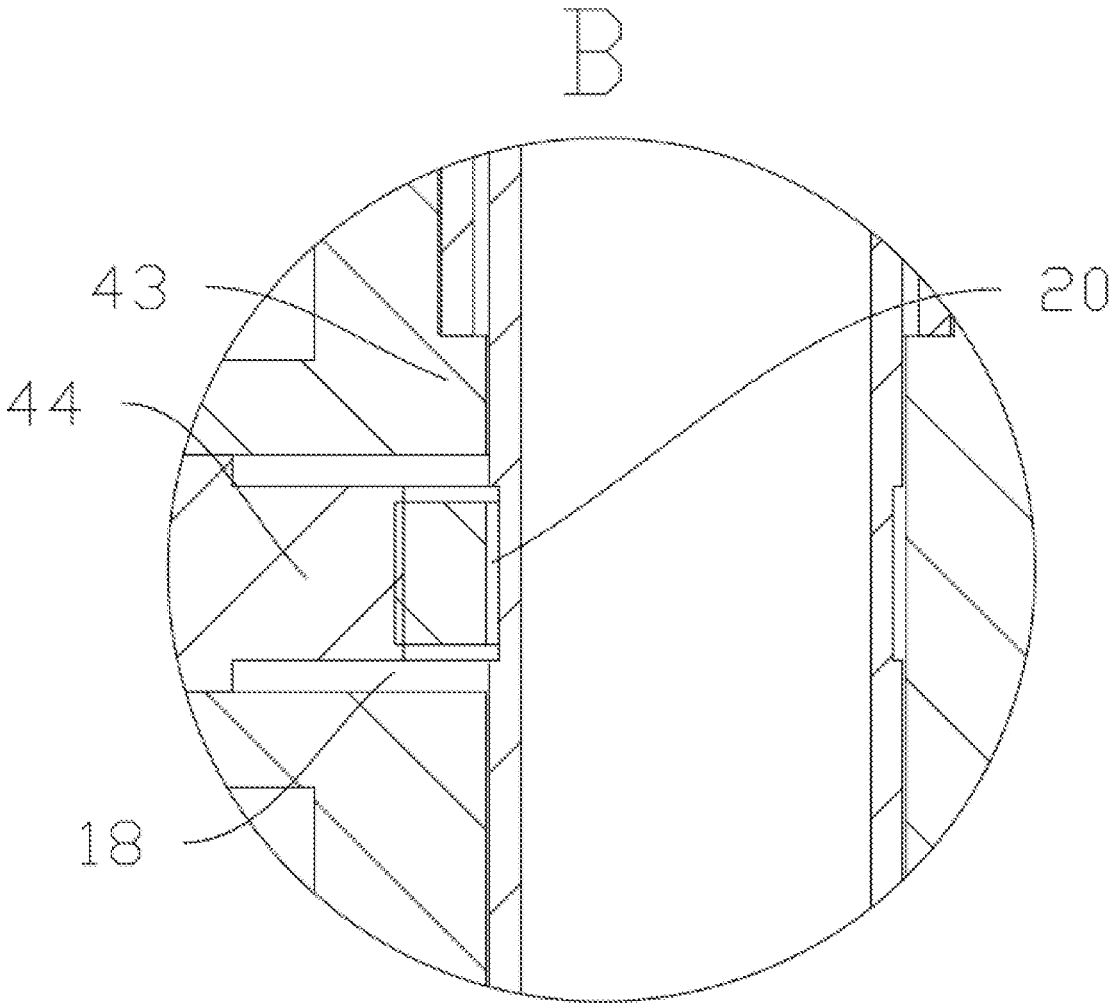
FIG. 6 is a partially enlarged diagram of the portion B in FIG. 5.
Figure 7:
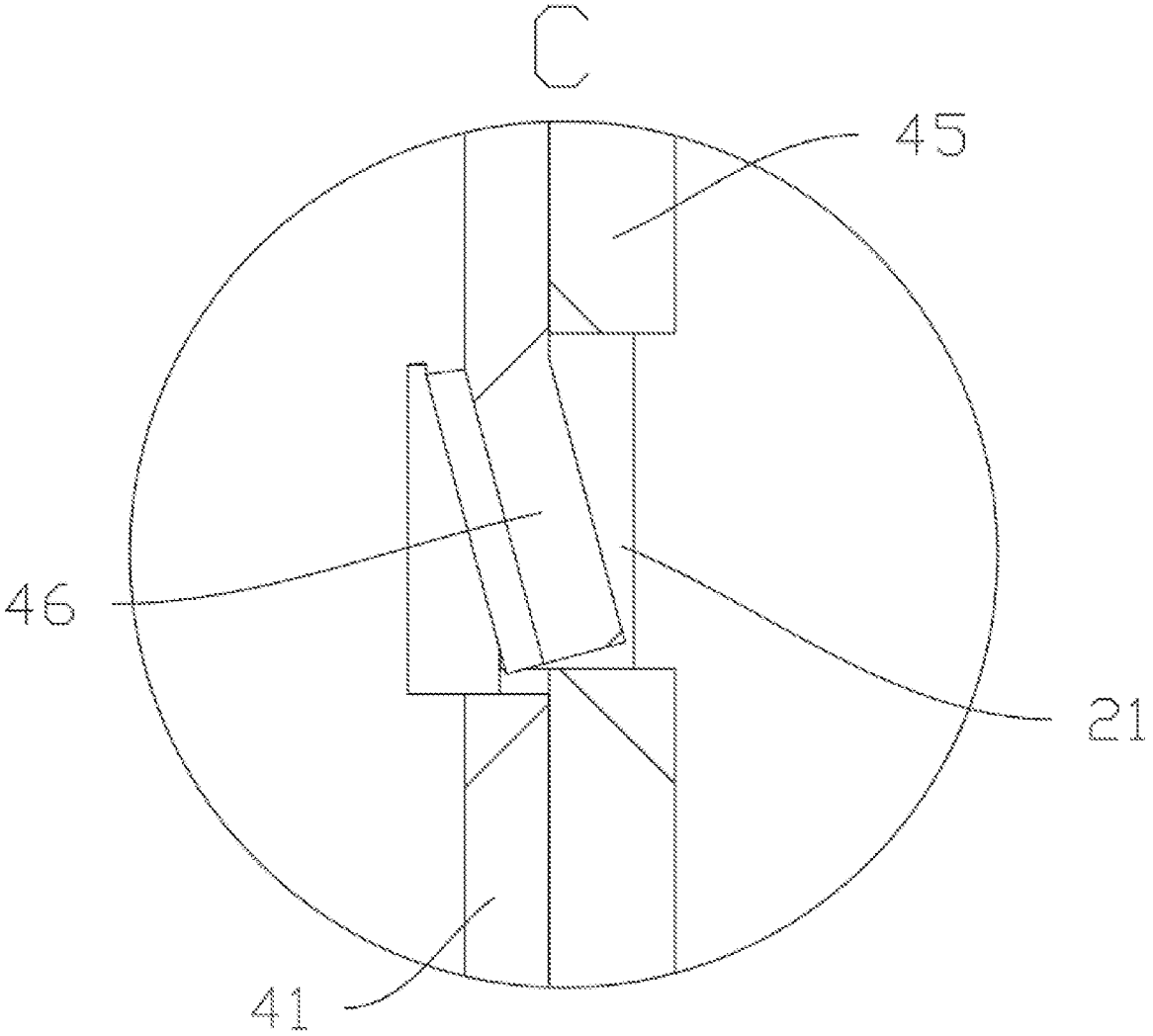
FIG. 7 is a partially enlarged diagram of the portion C in FIG. 5.

As shown in FIG. 1 and FIG. 5, each chair leg 4 includes an outer leg 41, an inner leg 42, a sleeve pipe 43, a lock piece 44, a connecting pipe 45, and an elastic clasp 46. The inner leg 42 is slidably connected into the outer leg 41. The sleeve pipe 43 sleeves the outer leg 41 and is located on an outer circumferential wall of a lower end of the outer leg 41. The lock piece 44 is rotatably connected to the sleeve pipe 43. The sleeve pipe 43 is provided with a third avoiding slot 18 for allowing the lock piece 44 to pass. The lock piece 44 can enter an inner cavity of the outer leg 41 via the third avoiding slot 18. The inner leg 42 is provided with a first clamping slot 19 and a second clamping slot 20, and the first clamping slot 19 is located above the second clamping slot 20. The first clamping slot 19 and the second clamping slot 20 are both annular slots. The lock piece 44 is rotated to be clamped into the first clamping slot 19 or the second clamping slot 20 via the third avoiding slot 18. As shown in FIG. 6, during use, the lock piece 44 is clamped into the second clamping slot 20, so that the inner leg 42 cannot extend out. When the chair legs 4 need to extend, the lock pieces 44 are rotated to be separated from the second clamping slots 20, and the inner legs 42 slide out of the outer legs 41 until the first clamping slots 19 reach the lock pieces 44. The lock pieces 44 are rotated to be clamped into the first clamping slots 19, so that the inner legs 42 cannot move, and the chair legs 4 are in an extended state. The chair legs 4 are hinged with the connecting seat 1 through the connecting pipes 45. As shown in FIG. 7, a through hole 21 is formed in an outer wall of the connecting pipe 45. An upper end of the elastic clasp 46 is connected to the outer leg 41, and a lower end is plugged into the through hole 21 and resist against a lower wall of the through hole 21. To achieve removal, the elastic clasp 46 is pushed to separate the outer leg 41 from the connecting pipe 45. A bottom end of each chair leg 4 is spherical and is sleeved with a rubber pad 17, and the rubber pad 17 is terrace-shaped. That is, a bottom end of the inner leg 42 is spherical and is sleeved with the rubber pad 17.

Figure 2:
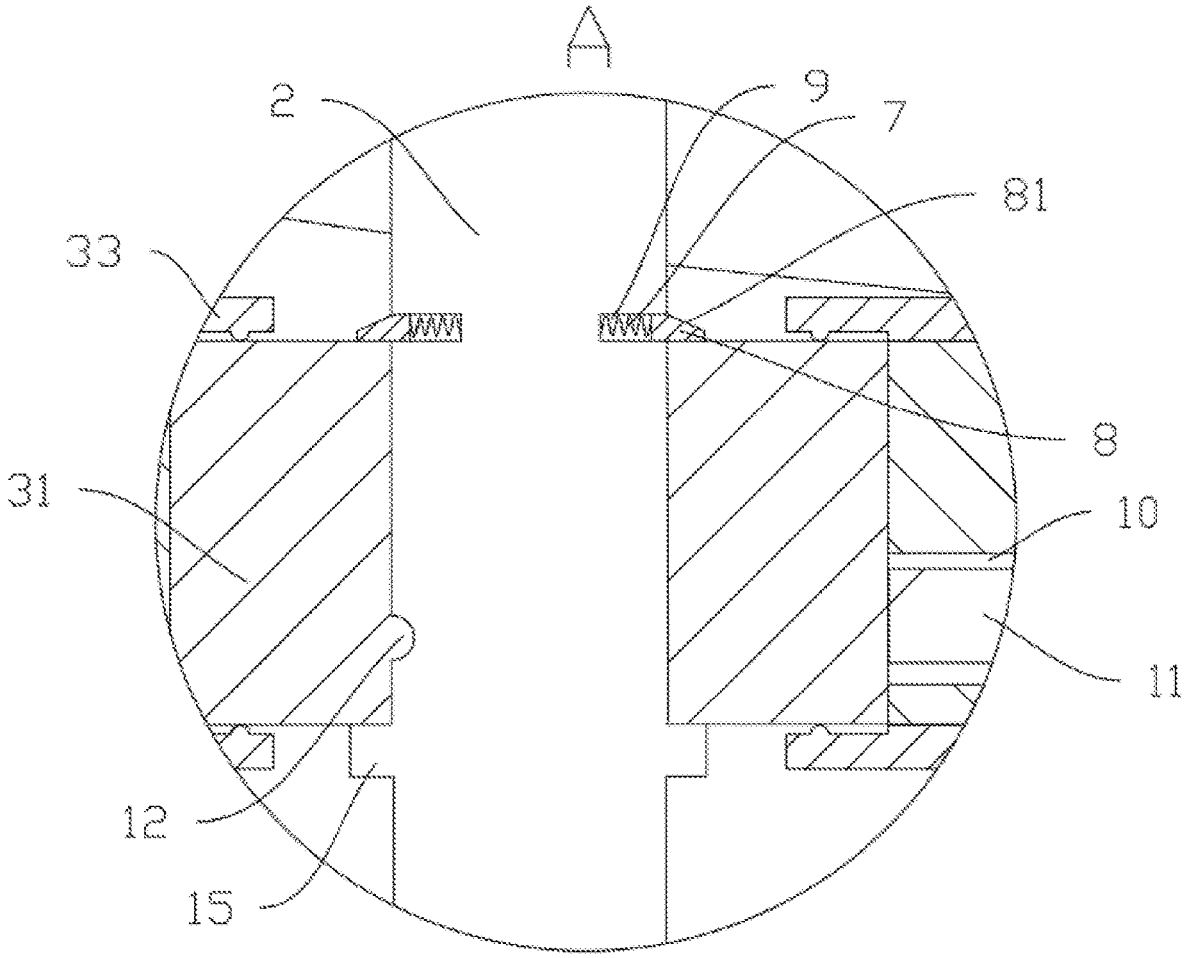
FIG. 2 is a partially enlarged diagram of the portion A in FIG. 1.
Figure 3:
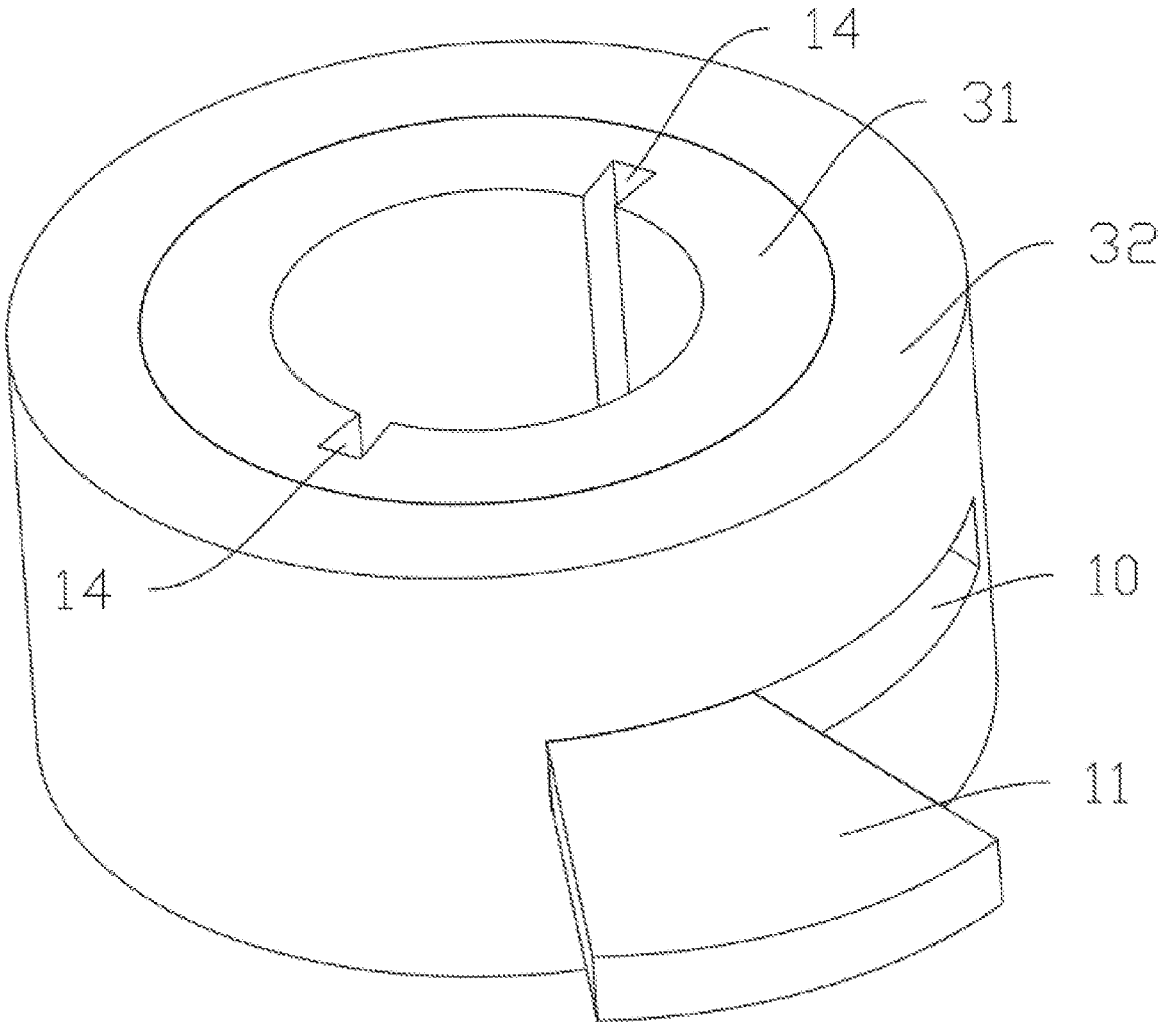
FIG. 3 is a partially schematic structural diagram of an inner sleeve and an outer sleeve in the present disclosure.
Figure 4:
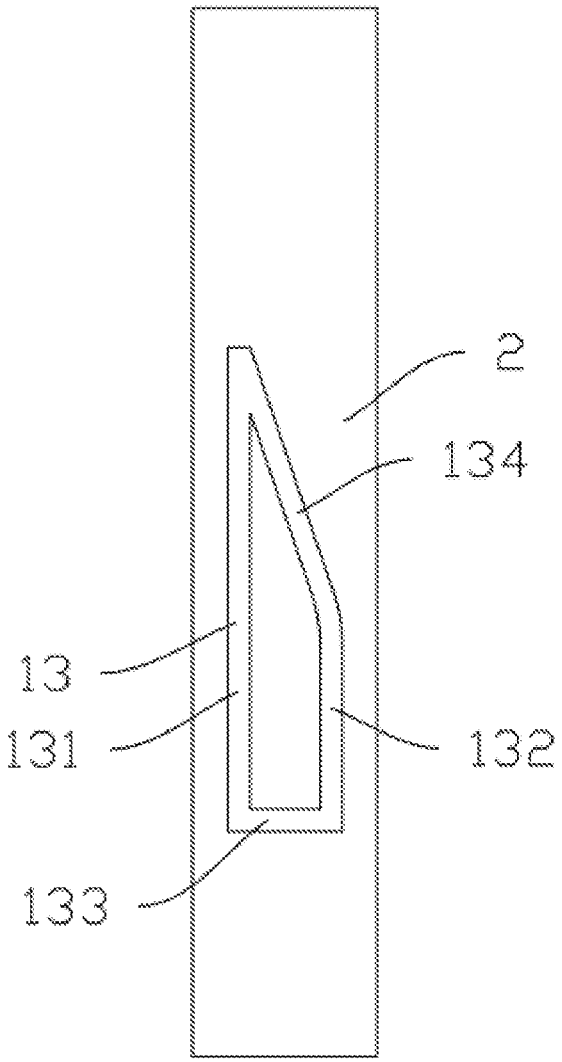
FIG. 4 is a schematic structural diagram of a sliding chute in the present disclosure.

As shown in FIG. 1, the guide rod 2 is vertically arranged and connected to a bottom end of the connecting seat 1. The guide sleeve 3 is slidably connected to the guide rod 2. Each connecting rod 5 is hinged with the guide sleeve 3 and one chair leg 4 respectively. The chair legs 4 are rotated by sliding the guide sleeve 3. The chair legs 4 support the folding chair framework when unfolded. The guide sleeve 3 include an inner sleeve 31 and an outer sleeve 32. The inner sleeve 31 is rotatably and slidably connected to the guide rod 2. The inner sleeve 31 is rotatably connected into the outer sleeve 32. The connecting rod 5 is hinged with the outer sleeve 32 and the sleeve pipe 43 respectively. In addition, the present disclosure further includes a first spring 6, second springs 7, and wedge-shaped blocks 8. Upper and lower ends of the first spring 6 are respectively connected to the connecting seat 1 and the guide sleeve 3. The lower end of the first spring 6 is connected to an upper end surface of the outer sleeve 32. The guide sleeve 3 in this embodiment further includes two annular limiting sheets 33. The two limiting sheets 33 are respectively connected to upper and lower ends of the outer sleeve 32 and respectively resist against upper and lower ends of the inner sleeve 31. As shown in FIG. 2, convex balls are arranged on end surfaces of the limiting sheets 33 facing the inner sleeve 31. The convex balls resist against the inner sleeve 31 to reduce contact areas between the limiting sheets 33 and the inner sleeve. Therefore, the lower end of the first spring 6 in this embodiment is connected to the limiting sheet 33 located above.

As shown in FIG. 2, the guide rod 2 is provided with first grooves 9. The wedge-shaped blocks 8 are horizontally slidably connected into the first grooves 9. The second springs 7 are transversely arranged, and two ends of the second springs 7 are respectively connected to side walls of the first grooves 9 and the wedge-shaped blocks 8. Wedge-shaped surfaces 81 are arranged at upper ends of the wedge-shaped blocks 8. Heights of the wedge-shaped surfaces 81 gradually decrease from inside to outside. In this embodiment, there are two wedge-shaped blocks 8 in total, which are respectively arranged on left and right sides of the guide rod 2. Correspondingly, there are also two first grooves 9 and two second springs 7. The outer sleeve 32 is circumferentially provided with a first avoiding slot 10. The inner sleeve 31 is connected with a pedal 11. The pedal 11 passes through the first avoiding slot 10 and is exposed out of the guide sleeve 3. The inner sleeve 31 is rotated by actuating the pedal 11 to slide along the first avoiding slot 10. A clamping ball 12 is arranged on an inner wall of the inner sleeve 31. A sliding chute 13 is formed in an outer wall of the guide rod 2. The clamping ball 12 is slidably connected into the sliding chute 13. The inner sleeve 31 is axially provided, in a penetrating manner, with second avoiding slots 14 for allowing the wedge-shaped blocks 8 to pass. When the guide sleeve 3 slides down from tops of the wedge-shaped blocks 8 to a bottom end of the inner sleeve 31 and resists against the wedge-shaped surfaces 81, the wedge-shaped surfaces 81 make the wedge-shaped blocks 8 move into the first grooves 9 and make the second springs 7 compressed. The guide rod 2 is provided with first limiting bulges 15 located below the wedge-shaped blocks 8. When the chair legs 4 are unfolded, upper and lower ends of the guide sleeve 3 respectively resist against bottom ends of the wedge-shaped blocks 8 and top ends of the first limiting bulges 15, and the first spring 6 is stretched. At this time, the pedal 11 is located at one end of the first avoiding slot 10. When the pedal 11 is rotated to the other end of the first avoiding slot 10, the second avoiding slots 14 are aligned with the wedge-shaped blocks 8 and can allow the wedge-shaped blocks 8 to pass. At this time, the first spring 6 actuates the guide sleeve 3 to move upwards. Furthermore, in the upwards moving process of the guide sleeve 3, the clamping ball 12 slides along the sliding chute 13 and makes the pedal 11 move to one end of the first avoiding slot 10.

The guide rod 2 is connected with second limiting bulges 16 located above the wedge-shaped blocks 8. The first spring 6 actuates the guide sleeve 3 to move upwards until an upper end surface of the guide sleeve 3 resists against bottom ends of the second limiting bulges 16.

The sliding chute 13 includes a first vertical section 131, a second vertical section 132, a horizontal section 133, and an inclined section 134. One end of the horizontal section 133 is connected to a lower end of the first vertical section 131. The other end of the horizontal section 133 is connected to a lower end of the second vertical section 132. A lower end of the inclined section 134 is connected to an upper end of the second vertical section 132. An upper end of the inclined section 134 is connected to an upper end of the first vertical section 131. When the guide sleeve 3 slides down, the clamping ball 12 slides along the first vertical section 131. When the pedal 11 moves from one end of the first avoiding slot 10 to the other end of the first avoiding slot 10, the clamping ball 12 moves from one end of the horizontal section 133 to the other end of the horizontal section 133. When the clamping ball 12 moves from the lower end of the inclined section 134 to the upper end of the inclined section 134, the pedal 11 moves from the other end of the first avoiding slot 10 to one end of the first avoiding slot 10.

In an initial state, the upper end of the guide sleeve 3 resists against the second limiting bulges 16; the pedal 11 is located at one end of the first avoiding slot 10; the wedge-shaped blocks 8 are staggered from the second avoiding slots 14; and the folding chair framework is in a folded state. The pedal 11 is treaded to make the guide sleeve 3 slide down. The clamping ball 12 slides down along the first vertical section 131. When the guide sleeve 3 is in contact with the wedge-shaped blocks 8, the wedge-shaped blocks 8 retract into the first grooves 9. After the guide sleeve 3 resists against the first limiting bulges 15, the upper end of the inner sleeve 31 also crosses the wedge-shaped blocks 8 and is located below the wedge-shaped blocks 8. The wedge-shaped blocks 8 pop up due to the elasticities of the second springs 7, so that the guide sleeve 3 is clamped between the wedge-shaped blocks 8 and the first limiting bulges 15. At this time, the clamping ball 12 reaches the lower end of the first vertical section 131, and the folding chair framework is unfolded. To fold the folding chair framework, the pedal 11 is rotated to move to the other end of the first avoiding slot 10, and the clamping ball 12 also moves along the horizontal section 133 to the other end of the horizontal section 133. The second avoiding slots 14 are aligned with the wedge-shaped blocks 8. The first spring 6 makes the guide sleeve 3 move upwards. The clamping ball 12 slides upwards along the second vertical section 132. When the wedge-shaped blocks 8 leave the second avoiding slots 14, the clamping ball 12 just moves to the upper end of the second vertical section 132. Later, the guide sleeve 3 continues to move upwards under the elasticity of the first spring 6. At this time, the clamping ball 12 moves upwards along the inclined section 134 to drive the inner sleeve 31 to rotate. so that the pedal 11 moves towards one end of the first avoiding slot 10. After the inner sleeve 31 resists against the second limiting bulges 16, the clamping ball 12 reaches the upper end of the first vertical section 131, and the pedal 11 also reaches one end of the first avoiding slot 10. The folding chair framework is folded.

The implementations of the present disclosure are described in detail above in combination with the accompanying drawings, but the present disclosure is not limited to one of the above implementations. All other implementations obtained by those skilled in the art without creative work shall fall within the protection scope of the present disclosure.

What is claimed is:

1. A folding chair framework, comprising a connecting seat (1), a guide rod (2), a guide sleeve (3), several chair legs (4), and several connecting rods (5), wherein upper ends of the chair legs (4) are all hinged with the connecting seat (1); the guide rod (2) is vertically arranged and connected to a bottom end of the connecting seat (1); the guide sleeve (3) is slidably connected to the guide rod (2); each connecting rod (5) is hinged with the guide sleeve (3) and one chair leg (4) respectively; the chair legs (4) are rotated by sliding the guide sleeve (3); the chair legs (4) support the folding chair framework when unfolded; the folding chair framework further comprises a first spring (6), second springs (7), and wedge-shaped blocks (8); upper and lower ends of the first spring (6) are respectively connected to the connecting seat (1) and the guide sleeve (3); the guide rod (2) is provided with first grooves (9); the wedge-shaped blocks (8) are slidably connected into the first grooves (9); the second springs (7) are transversely arranged, and two ends of the second springs (7) are respectively connected to side walls of the first grooves (9) and the wedge-shaped blocks (8); wedge-shaped surfaces (81) are arranged at upper ends of the wedge-shaped blocks (8); the guide sleeve (3) comprises an inner sleeve (31) and an outer sleeve (32); the inner sleeve (31) is rotatably and slidably connected to the guide rod (2); the inner sleeve (31) is rotatably connected into the outer sleeve (32); the outer sleeve (32) is circumferentially provided with a first avoiding slot (10); the inner sleeve (31) is connected with a pedal (11); the pedal (11) passes through the first avoiding slot (10) and is exposed out of the guide sleeve (3); the inner sleeve (31) is rotated by actuating the pedal (11) to slide along the first avoiding slot (10); a clamping ball (12) is arranged on an inner wall of the inner sleeve (31); a sliding chute (13) is formed in an outer wall of the guide rod (2); the clamping ball (12) is slidably connected into the sliding chute (13); the inner sleeve (31) is axially provided with second avoiding slots (14) in a penetrating manner; when the guide sleeve (3) slides down from tops of the wedge-shaped blocks (8) to a bottom end of the inner sleeve (31) and resists against the wedge-shaped surfaces (81), the wedge-shaped surfaces (81) make the wedge-shaped blocks (8) move into the first grooves (9) and make the second springs (7) compressed; the guide rod (2) is provided with first limiting bulges (15) located below the wedge-shaped blocks (8); when the chair legs (4) are unfolded, upper and lower ends of the guide sleeve (3) respectively resist against bottom ends of the wedge-shaped blocks (8) and top ends of the first limiting bulges (15), and the first spring (6) is stretched; the pedal (11) is located at one end of the first avoiding slot (10); when the pedal (11) is rotated to the other end of the first avoiding slot (10), the second avoiding slots (14) are aligned with the wedge-shaped blocks (8) and allow the wedge-shaped blocks (8) to pass, and at the same time, the first spring (6) actuates the guide sleeve (3) to move upwards; in the upwards moving process of the guide sleeve (3), the clamping ball (12) slides along the sliding chute (13) and makes the pedal (11) move to one end of the first avoiding slot (10).

2. The folding chair framework according to claim 1, wherein the lower end of the first spring (6) is connected to an upper end surface of the outer sleeve (32).

3. The folding chair framework according to claim 1, wherein the guide rod (2) is connected with second limiting bulges (16) located above the wedge-shaped blocks (8); the first spring (6) actuates the guide sleeve (3) to move upwards until an upper end surface of the guide sleeve (3) resists against bottom ends of the second limiting bulges (16).

4. The folding chair framework according to claim 1, wherein a bottom end of each chair leg (4) is spherical and is sleeved with a rubber pad (17); and the rubber pad (17) is terrace-shaped.

5. The folding chair framework according to claim 1, wherein each chair leg (4) comprises an outer leg (41), an inner leg (42), a sleeve pipe (43), and a lock piece (44); the inner leg (42) is slidably connected into the outer leg (41); the sleeve pipe (43) sleeves the outer leg (41); one end of each connecting rod (5) is hinged with the sleeve pipe (43); the lock piece (44) is rotatably connected to the sleeve pipe (43); the sleeve pipe (43) is provided with a third avoiding slot (18) for allowing the lock piece (44) to pass; the inner leg (42) is provided with a first clamping slot (19) and a second clamping slot (20), and the first clamping slot (19) is located above the second clamping slot (20); and the lock piece (44) is rotated to be clamped into the first clamping slot (19) or the second clamping slot (20).

6. The folding chair framework according to claim 5, wherein the chair leg (4) further comprises a connecting pipe (45) and an elastic clasp (46); the connecting pipe (45) is hinged with the connecting seat (1); a through hole (21) is formed in an outer wall of the connecting pipe (45); an upper end of the elastic clasp (46) is connected to the outer leg (41); and a lower end is plugged into the through hole (21) and resists against a lower wall of the through hole (21).

7. The folding chair framework according to claim 1, wherein the guide sleeve (3) further comprises two annular limiting sheets (33); and the two limiting sheets (33) are respectively connected to upper and lower ends of the outer sleeve (32) and respectively resist against upper end lower ends of the inner sleeve (31).

8. The folding chair framework according to claim 1, wherein the sliding chute (13) comprises a first vertical section (131), a second vertical section (132), a horizontal section (133), and an inclined section (134); one end of the horizontal section (133) is connected to a lower end of the first vertical section (131); the other end of the horizontal section (133) is connected to a lower end of the second vertical section (132); a lower end of the inclined section (134) is connected to an upper end of the second vertical section (132); an upper end of the inclined section (134) is connected to an upper end of the first vertical section (131); when the guide sleeve (3) slides down, the clamping ball (12) slides along the first vertical section (131); when the pedal (11) moves from one end of the first avoiding slot (10) to the other end of the first avoiding slot (10), the clamping ball (12) moves from one end of the horizontal section (133) to the other end of the horizontal section (133); and when the clamping ball (12) moves from the lower end of the inclined section (134) to the upper end of the inclined section (134), the pedal (11) moves from the other end of the first avoiding slot (10) to one end of the first avoiding slot (10).

* * * * *